US010278514B1

(12) United States Patent
Emerson

(10) Patent No.: US 10,278,514 B1
(45) Date of Patent: May 7, 2019

(54) CHILD WRAP

(71) Applicant: Deidre Vaughn Emerson, Brentwood, TN (US)

(72) Inventor: Deidre Vaughn Emerson, Brentwood, TN (US)

( * ) Notice: Subject to any disclaimer, the term of this patent is extended or adjusted under 35 U.S.C. 154(b) by 132 days.

(21) Appl. No.: 15/649,907

(22) Filed: Jul. 14, 2017

(51) Int. Cl.
*A41B 13/06* (2006.01)
*A47D 13/02* (2006.01)

(52) U.S. Cl.
CPC ..... *A47D 13/02* (2013.01); *A41B 13/06* (2013.01); *A41B 2400/32* (2013.01)

(58) Field of Classification Search
CPC ..... A41B 2400/32; A41B 13/06; A61H 1/008
See application file for complete search history.

(56) References Cited

U.S. PATENT DOCUMENTS 3,486,501 A 12/1969 Erickson
5,361,418 A 11/1994 Luzenske
5,782,790 A 7/1998 Allen
5,819,747 A 10/1998 Timms
7,954,187 B1 * 6/2011 Earnest ..... A61F 5/3723 2/69
8,011,037 B1 * 9/2011 Earnest ..... A41B 13/06 128/872
8,191,189 B1 * 6/2012 Spell ..... A47G 9/083 5/494
8,291,867 B2 10/2012 Blizzard
8,302,225 B1 * 11/2012 Earnest ..... A47G 9/083 5/413 R
9,289,076 B2 * 3/2016 Mullins ..... A47D 13/02
9,452,100 B2 9/2016 Bigelow
2004/0019969 A1 * 2/2004 Gatten ..... A41B 13/06 5/482
2004/0182895 A1 * 9/2004 Paul ..... A47D 13/025 224/159
2005/0150047 A1 * 7/2005 Trani ..... A41B 13/06 5/482
2005/0210585 A1 * 9/2005 French ..... A41B 13/06 5/494
2007/0056098 A1 * 3/2007 Schmid ..... A41B 13/06 5/482
2007/0061968 A1 * 3/2007 Fader ..... A47D 15/008 5/494
2009/0064390 A1 * 3/2009 Beiring ..... A41B 13/06 2/80
2010/0192304 A1 * 8/2010 Kovalyak ..... A47D 13/08 5/655
2011/0180079 A1 * 7/2011 Krawchuk ..... A41B 13/06 128/873
2013/0053750 A1 2/2013 Taylor
2013/0302555 A1 * 11/2013 Dunn ..... A41B 13/06 428/78
2014/0238085 A1 8/2014 Smith
2015/0038887 A1 * 2/2015 Piccirillo ..... A61H 7/004 601/112

* cited by examiner

*Primary Examiner* — Justin Larson
(74) *Attorney, Agent, or Firm* — Shane Cortesi

(57) ABSTRACT

The present invention relates to a child wrap, which may be in the form of a continuous piece of fabric and include a center panel, left and right shoulder straps, a bottom strap, and left and right panels, at least one of which is elongated. The panels preferably attach to one another via hook and loop fasteners as they wrap around the child. Preferably, the child's arms are free while wearing the wrap.

20 Claims, 6 Drawing Sheets

CHILD WRAP

BACKGROUND

Technical Field

The present invention relates to wearables, more particularly to wraps for children.

Background of the Invention

Swaddles have been used for generations in order to assist infants in sleeping. Unfortunately, swaddles usually immobilize the child's arms, which is not always desired.

BRIEF SUMMARY

The present disclosure provides a child wrap as described herein. As opposed to encouraging sleep like a swaddle, the child wrap of the present invention preferably allows for full range of motion and is preferably used to calm anxiety of a child, especially for children with colic and/or anxiety.

In some embodiments, the present disclosure provides a method of providing comfort to a human having a head, a left arm, a right arm, a left armpit, a right armpit, a neck, a left shoulder, a right shoulder, a groin region, a torso having a front side and a rear side, a left leg and a right leg, the method comprising the steps of: a) providing a wrap that may include i) a center panel that may have a center panel front surface, a center panel rear surface comprising a center panel rear fastener, a center panel top, a center panel bottom, a center panel height extending from the center panel top to the center panel bottom, a center panel left side, a center panel right side, and a center panel width extending from the center panel left side to the center panel right side; ii) a left panel that may extend from the center panel left side and that may comprise a left panel top, a left panel bottom, a left panel height extending from the left panel top to the left panel bottom and generally parallel to the center panel height, a left panel left side, a left panel right side, a left panel width extending from the left panel left side to the left panel right side and generally parallel to the center panel width, a left panel front surface, and a left panel rear surface comprising a fastener; iii) left and right shoulder straps that may extend from the center panel top, each of the left and right shoulder straps may comprise a front surface comprising a fastener and a rear surface, the left and right shoulder straps separated by a cavity; iv) a bottom strap that may extend from the center panel bottom and that may comprise a front surface comprising a bottom strap fastener, a rear surface, a bottom strap top, a bottom strap bottom, a bottom strap height extending from the bottom strap top to the bottom strap bottom and generally parallel to the center panel height, a bottom strap width generally perpendicular to the bottom strap height and generally parallel to the center panel width; and v) a right panel that may extend from the center panel right side that may comprise a right panel top, a right panel bottom, a right panel height extending from the right panel top to the right panel bottom and generally parallel to the center panel height and the left panel height, a right panel left side, a right panel right side, a right panel width extending from the right panel left side to the right panel right side and generally parallel to the center panel width and the left panel width, a right panel front surface comprising at least one left fastener and at least one right fastener located for example 1 inch to about 8 inches for example to the right of the at least one left fastener. The at least one right fastener may be adjacent to the right panel right side. Optionally, the right panel width is substantially larger than the center panel width and the left panel width, and optionally, the right panel height is substantially equal to the left panel height. Optionally, the method further comprises b) placing the rear side of the human's torso against the front surface of the center panel and positioning the human so that the bottom strap is located between the human's legs and the bottom strap bottom end is below the human's groin region. Optionally, the method further comprises c) folding the left panel toward the human's torso and the center panel along a foldline located at the intersection of the center panel and the left panel, while maintaining the left panel below the human's left shoulder and below the human's head, so that the left panel front surface confronts the front side of the human's torso and so that the left panel is located to the right of the human's left arm and below the human's left armpit. Optionally, the method further comprises d) folding the bottom strap, along a foldline located at the intersection of the center panel and the bottom strap, so that the bottom strap bottom moves toward the left panel rear surface and moves around the human's groin region. Optionally, the method further comprises e) connecting the bottom strap fastener to the left panel fastener. Optionally, the method further comprises f) folding the left and right shoulder straps, along foldlines located at the intersection of the center panel and the left and right shoulder straps, so that the left and right shoulder strap top move over the human's shoulders. Optionally, the method further comprises g) connecting the fasteners on the left and right shoulder straps to the fasteners on the left panel rear surface. Optionally, the method further comprises h) folding the right panel toward the human's torso, the left and right shoulder straps, the bottom strap, the left panel and the center panel along a foldline located at the intersection of the center panel and the right panel, while maintaining the right panel below the human's right shoulder and below the human's head, so that a portion of the right panel front surface confronts and attaches to the rear side of the left panel and is located in front of the front side of the human's torso and so that the at least one left fastener of the right panel attaches to the left panel rear surface fastener and so that the right panel is located to the left of the human's right arm and below the human's right armpit. Optionally, the method further comprises i) moving the right side of the right panel between the human's torso and the human's left arm below the human's left armpit and then behind the human's torso so that the right side of the right panel is behind the center panel. Optionally, the method further comprises j) connecting the at least one right side fastener of the right panel to the center panel rear surface fastener. Optionally, said fasteners are hook and loop fasteners. Optionally, said fasteners are hook and loop fastener strips. Optionally, the left panel, the center panel, the left and right shoulder straps, the bottom strap, and the right panel are a single piece of fabric. Optionally, in step b), the rear surfaces of the left panel, the center panel, the left and right shoulder straps, the bottom strap and the right panel are located on a surface (e.g., the ground or a table). Optionally, the bottom strap is located opposite the cavity created by the left and right shoulder straps and is located approximately in the widthwise center of the center panel. Optionally, the left panel and the right panel are generally rectangular in shape. Optionally, the bottom strap width tapers from the bottom strap top to the bottom strap bottom. Optionally, the at least one left fastener of the right panel is oriented generally perpendicular to the at least one right fastener of the right panel. Optionally, the bottom strap fastener is located adjacent to the bottom strap bottom end. Optionally, the human's arms are free (i.e., unencumbered by the child wrap) during steps a-j. The aforementioned method is particularly useful for right-handed adult users.

Optionally, the present disclosure provides a method for left handed adult users that includes. More particularly, the present disclosure provides a method of providing comfort to a human having a head, a left arm, a right arm, a left armpit, a right armpit, a neck, a left shoulder, a right shoulder, a groin region, a torso having a front side and a rear side, a left leg and a right leg, the method comprising the steps of: a) providing a wrap that may comprise: i) a center panel that may have a center panel front surface, a center panel rear surface comprising a center panel rear fastener, a center panel top, a center panel bottom, a center panel height extending from the center panel top to the center panel bottom, a center panel left side, a center panel right side, and a center panel width extending from the center panel left side to the center panel right side; ii) a left panel that may extend from the center panel left side and that may comprise a left panel top, a left panel bottom, a left panel height extending from the left panel top to the left panel bottom and generally parallel to the center panel height, a left panel left side, a left panel right side, a left panel width extending from the left panel left side to the left panel right side and generally parallel to the center panel width, a left panel front surface comprising at least one left fastener, which may be adjacent to the left panel left side, and at least one right fastener located about 1 inch to about 8 inches for example to the right of the at least one left fastener, and a left panel rear surface; iii) left and right shoulder straps that may extend from the center panel top, each of the left and right shoulder straps may comprise a front surface comprising a fastener and a rear surface, the left and right shoulder straps separated by a cavity; iv) a bottom strap that may extend from the center panel bottom and that may comprise a front surface comprising a bottom strap fastener, a rear surface, a bottom strap top, a bottom strap bottom, a bottom strap height extending from the bottom strap top to the bottom strap bottom and generally parallel to the center panel height, a bottom strap width generally perpendicular to the bottom strap height and generally parallel to the center panel width; and v) a right panel that may extend from the center panel right side and may comprise a right panel top, a right panel bottom, a right panel height extending from the right panel top to the right panel bottom and generally parallel to the center panel height and the left panel height, a right panel left side, a right panel right side, a right panel width extending from the right panel left side to the right panel right side and generally parallel to the center panel width and the left panel width, a right panel front surface and a rear panel rear surface. Optionally, the left panel width is substantially larger than the center panel width and the right panel width. Optionally, the left panel height is substantially equal to the right panel height. Optionally, the method further includes b) placing the rear side of the human's torso against the front surface of the center panel and positioning the human so that the bottom strap is located between the human's legs and the bottom strap bottom end is below the human's groin region. Optionally, the method further includes c) folding the right panel toward the human's torso and the center panel along a foldline located at the intersection of the center panel and the right panel, while maintaining the right panel below the human's right shoulder and below the human's head, so that the right panel front surface confronts the front side of the human's torso and so that the right panel is located to the left of the human's right arm and below the human's right armpit. Optionally, the method further includes d) folding the bottom strap, along a foldline located at the intersection of the center panel and the bottom strap, so that the bottom strap bottom moves toward the right panel rear surface and moves around the human's groin region. Optionally, the method further includes e) connecting the bottom strap fastener to the right panel fastener. Optionally, the method further includes f) folding the left and right shoulder straps, along foldlines located at the intersection of the center panel and the left and right shoulder straps, so that the left and right shoulder strap top move over the human's shoulders. Optionally, the method further includes g) connecting the fasteners on the left and right shoulder straps to the fasteners on the right panel rear surface. Optionally, the method further includes h) folding the left panel toward the human's torso, the left and right shoulder straps, the bottom strap, the right panel and the center panel along a foldline located at the intersection of the center panel and the left panel, while maintaining the left panel below the human's left shoulder and below the human's head, so that a portion of the left panel front surface confronts and attaches to the rear side of the right panel and is located in front of the front side of the human's torso and so that the at least one right fastener of the left panel attaches to the right panel rear surface fastener and so that the left panel is located to the right of the human's left arm and below the human's left armpit. Optionally, the method further includes i) moving the left side of the left panel between the human's torso and the human's right arm below the human's right armpit and then behind the human's torso so that the left side of the left panel is behind the center panel. Optionally, the method further includes j) connecting the at least one right side fastener of the left panel to the center panel rear surface fastener. Optionally, said fasteners are hook and loop fasteners. Optionally, said fasteners are hook and loop fastener strips. Optionally, the left panel, the center panel, the left and right shoulder straps, the bottom strap, and the right panel are a single piece of fabric. Optionally, in step b, the rear surfaces of the left panel, the center panel, the left and right shoulder straps, the bottom strap and the right panel are located on a surface. Optionally, the bottom strap is located opposite the cavity created by the left and right shoulder straps and is located approximately in the widthwise center of the center panel. Optionally, the left panel and the right panel are generally rectangular in shape. Optionally, the bottom strap width tapers from the bottom strap top to the bottom strap bottom. Optionally, the at least one left fastener of the left panel is oriented generally perpendicular to the at least one right fastener of the right panel. Optionally, the bottom strap fastener is located adjacent to the bottom strap bottom end. Optionally, the human's arms are free (i.e., unencumbered by the child wrap) during steps a-j.

DETAILED DESCRIPTION

Figure 1:
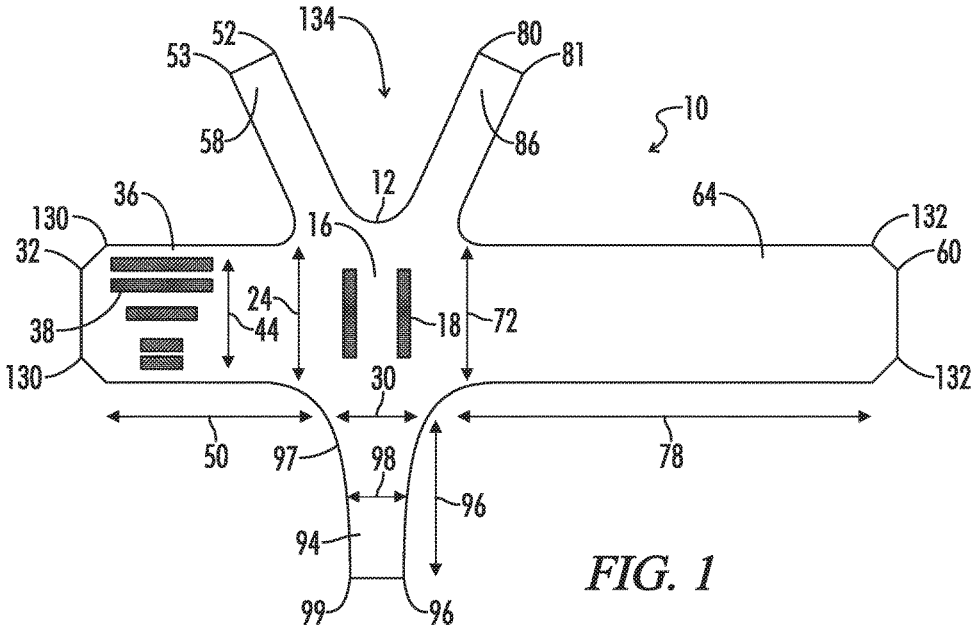
FIG. 1 illustrates a rear plan view of a child wrap of an embodiment of the present invention prior to folding.

With reference to FIGS. 1-12, the present invention provides a child wrap 10. In the drawings, not all reference numbers are included in each drawing for the sake of clarity.

Referring further to FIGS. 1-12, the child wrap 10 includes a center panel 12, which may have a center panel front surface 14, a center panel rear surface 16 comprising a center panel rear fastener 18, a center panel top 20, a center panel bottom 22, a center panel height 24 extending from the center panel top 20 to the center panel bottom 22, a center panel left side 26, a center panel right side 28, and a center panel width 30 extending from the center panel left side 26 to the center panel right side 28. In an exemplary embodiment, the center panel width 30 may be from about 6 inches to about 12 inches and the center panel height 24 may be from about from about 6 inches to about 12 inches. It will be understood that the measurements provided herein are purely exemplary and dimensions may vary depending on the size of the user.

Figure 2:
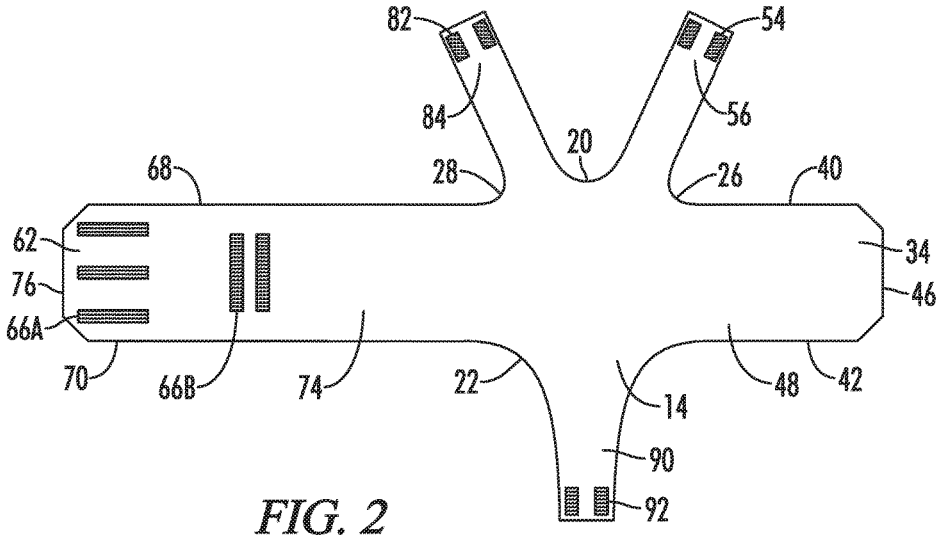
FIG. 2 illustrates a front plan view of the child wrap of FIG. 1 prior to folding.
Figure 7:
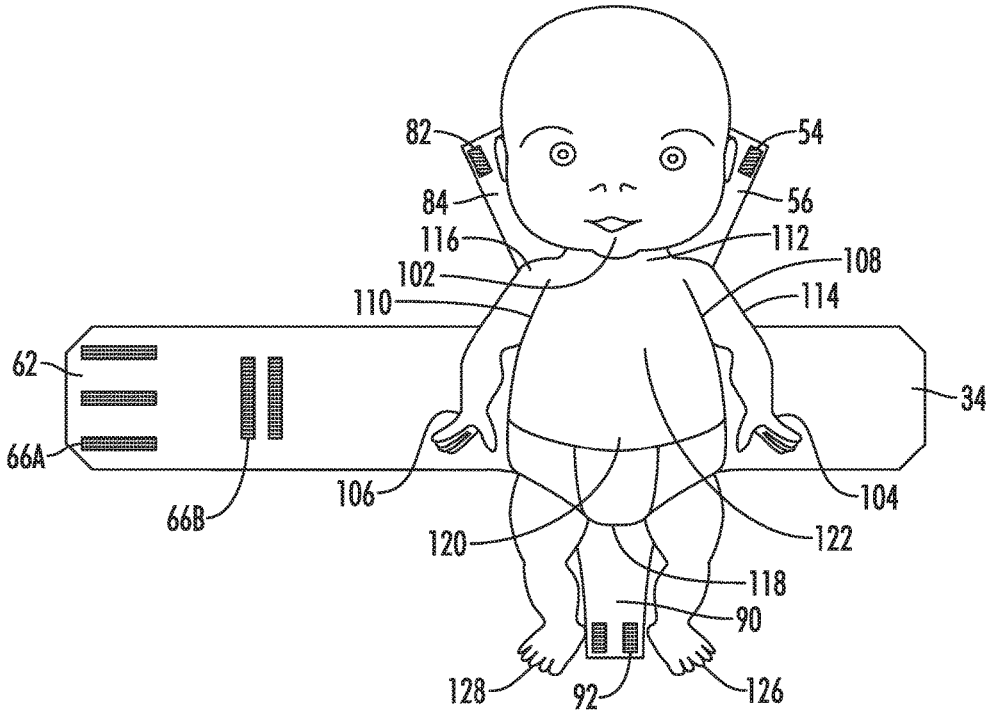
FIG. 7 is a front plan view of the child wrap similar to that shown in FIG. 2 except that a child has been used to illustrate how the child wrap would be used with a child.

The child wrap 10 may also include a left panel 32 extending from the center panel left side 26 and comprising a left panel top 40, a left panel bottom 42, a left panel height 44 extending from the left panel top 40 to the left panel bottom 42 and generally parallel to the center panel height 24, a left panel left side 46, a left panel right side 48, a left panel width 50 extending from the left panel left side 46 to the left panel right side 48 and generally parallel to the center panel width 30, a left panel front surface 34, and a left panel rear surface 36 comprising a fastener 38. It will be understood that the parts are assigned with reference to the child wrap 10 prior to folding the child wrap 10 (i.e., as shown in FIGS. 1, 2 and 7). Additionally, the parts are given with reference to the orientation of a child 100, as shown in FIG. 7. The left panel width 50 may be slightly larger than the center panel width 30 and may be from about 9 inches to about 14 inches for example and the left panel height 44 may be substantially equal to the center panel height 24 and may be from about 6 inches to about 9 inches. Again, the measurements provided herein are purely exemplary.

The child wrap 10 may also include left and right shoulder straps 52 and 80 extending from the center panel top 20, each of the left and right shoulder straps 52 80 comprising a front surface 56 and 84 comprising a fastener 54 82 and a rear surface 58 and 86, the left and right shoulder straps 52 and 80 separated by a cavity 134 configured to receive the human's neck 112. The left and right shoulder straps 52 80 may have a greater height than width as shown in FIGS. 1-12. Exemplary height dimensions are between about 6 inches and about 12 inches for example and exemplary width dimensions are between about 1 and about 3 inches for example. Preferably, the left and right shoulder straps 52 and 80 have the same dimensions as each other.

The child wrap 10 may also include a bottom strap 88 extending from the center panel bottom 22 and comprising a front surface 90 comprising a bottom strap fastener 92, a rear surface 94, a bottom strap top 97, a bottom strap bottom 99, a bottom strap height 96 extending from the bottom strap top 97 to the bottom strap bottom 99 and generally parallel to the center panel height 24, a bottom strap width 98 generally perpendicular to the bottom strap height 96 and generally parallel to the center panel width 30. The bottom strap 88 may have a greater height 96 than width 98 (even at the top of the bottom strap 97) as shown in FIGS. 1-12. Exemplary heights include from about 6 inches to about 12 inches and exemplary widths (as measured at the top of the bottom strap 97) of from about 4 inches to about 8 inches.

The child wrap 10 may also include a right panel 60 extending from the center panel right side 28 and comprising a right panel top 68, a right panel bottom 70, a right panel height 72 extending from the right panel top 68 to the right panel bottom 70 and generally parallel to the center panel height 24 and the left panel height 44, a right panel left side 74, a right panel right side 76, a right panel width 78 extending from the right panel left side 74 to the right panel right side 76 and generally parallel to the center panel width 30 and the left panel width 50, a right panel front surface 62 comprising at least one left fastener 66B adjacent to the right panel left side 74 and at least one right fastener 66A located to the right of the at least one left fastener 66B and a right panel rear surface 64. The right panel width 78 may be from about 16 inches to about 22 inches for example and the left panel height 44 may be substantially equal to the center panel height 24 and may be from about 6 inches to about 9 inches. Again, the dimensions provided herein are merely exemplary.

Optionally, as best seen in FIGS. 1-2, the right panel width 78 is substantially larger than the center panel width 30 and the left panel width 50. Optionally, the right panel height 72 is substantially equal to the left panel height 44 and the center panel height 24.

Optionally, the child wrap 10 is used in a method that includes providing the child wrap 10 and placing the rear side of the human's torso 124 against the front surface of the center panel 14 and positioning the human 100 so that the bottom strap 88 is located between the human's legs 126 and 128 and the bottom strap bottom 99 end is below the human's groin region 118, and the left panel 32 and the right panel 60 are below the human's shoulders 114 and 116, as shown in FIG. 7 (with a child 100) and FIG. 2 (without the child).

Figure 3:
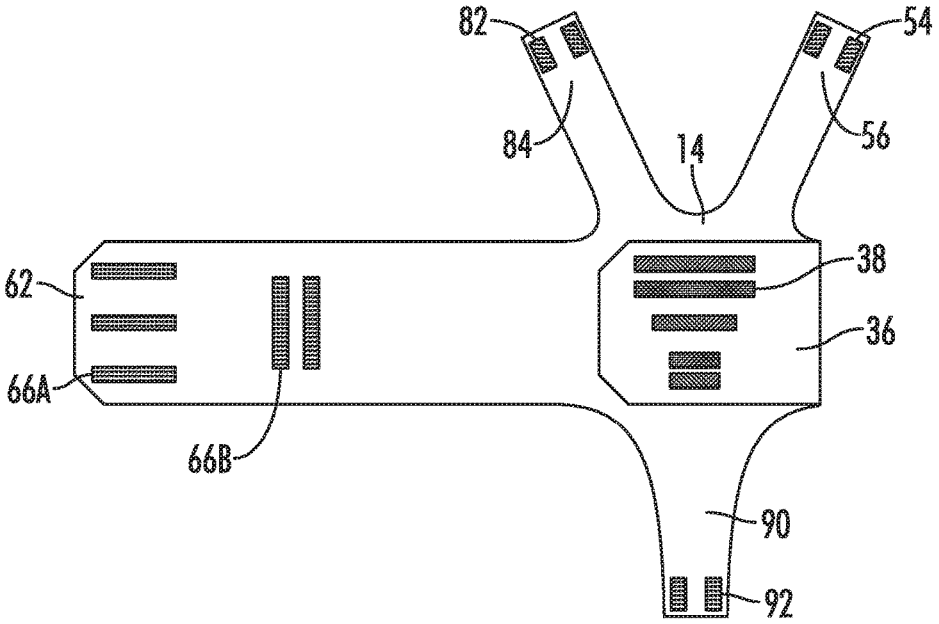
FIG. 3 illustrates a front plan view of the child wrap of FIG. 2 after folding the left panel towards the center panel along a foldline located at the intersection of the center panel and the left panel.
Figure 8:
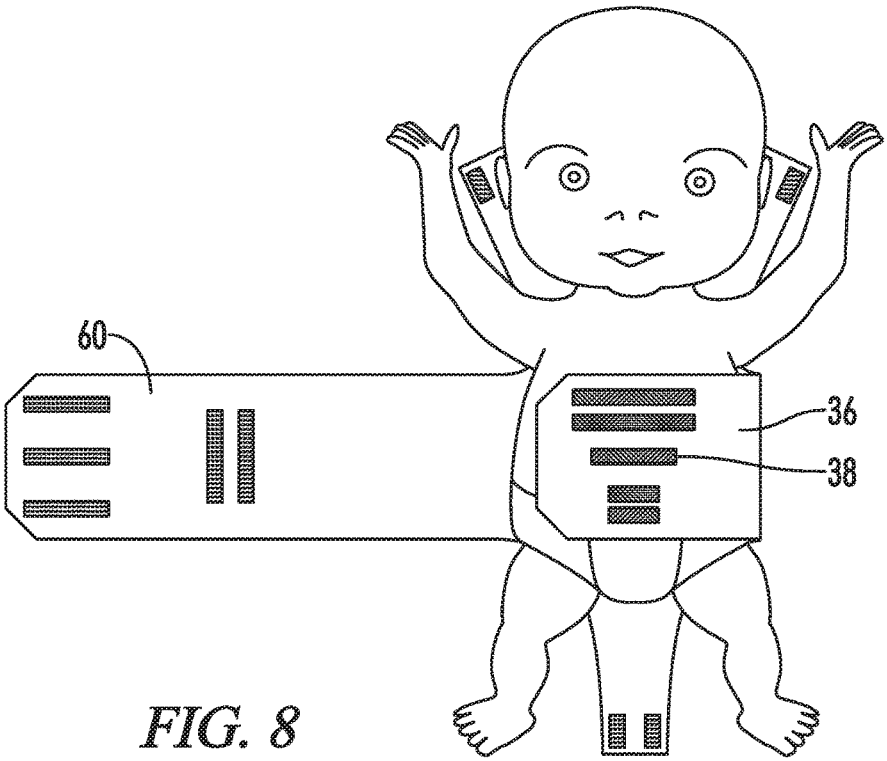
FIG. 8 is a front plan view of the child wrap similar to that shown in FIG. 3 except that a child has been used to illustrate how the child wrap would be used with a child.

The method may then include folding the left panel 32 toward the human's torso 120 and the center panel 12 along a foldline located at the intersection of the center panel 12 and the left panel 32, while maintaining the left panel 32 below the human's left shoulder 114 and below the human's head 102, so that the left panel front surface 34 confronts the front side of the human's torso 122 and so that the left panel 32 is located to the right of the human's left arm 104 and below the human's left armpit 108 (i.e., the left arm 104 is not captured by the left panel 32), as shown in FIGS. 8 and 3.

Figure 4:
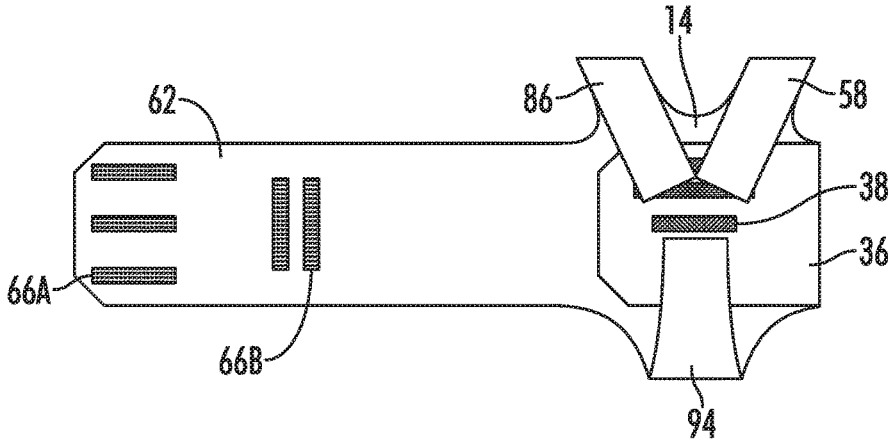
FIG. 4 illustrates a front plan view of the child wrap of FIG. 3 after folding the bottom strap, along a foldline located at the intersection of the center panel and the bottom strap and connecting the bottom strap fastener to the left panel fastener and folding the left and right shoulder straps, along foldlines located at the intersection of the center panel and the left and right shoulder straps and connecting the fasteners on the left and right shoulder straps to the fasteners on the left panel rear surface.
Figure 9:
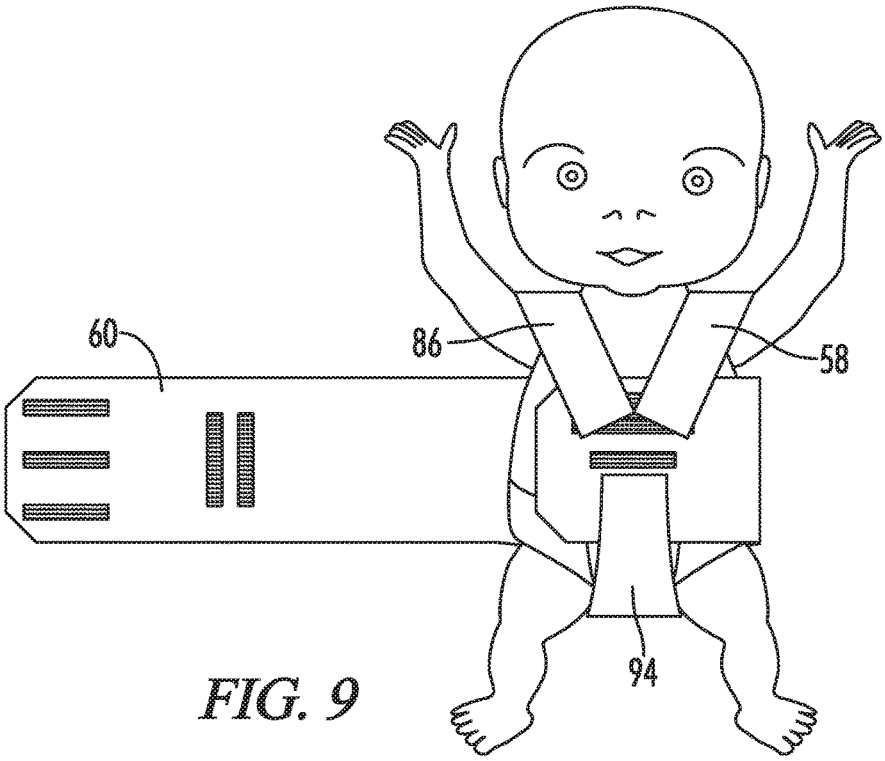
FIG. 9 is a front plan view of the child wrap similar to that shown in FIG. 4 except that a child has been used to illustrate how the child wrap would be used with a child.

The method may then include folding the bottom strap 88, along a foldline located at the intersection of the center panel 12 and the bottom strap 88, so that the bottom strap bottom 99 moves toward the left panel rear surface 36 and moves around the human's groin region 118 and connecting the bottom strap fastener 92 to the left panel fastener 38, as shown in FIGS. 9 and 4.

Before or after folding the bottom strap 88, the method may include folding the left and right shoulder straps 52 and 80, along foldlines located at the intersection of the center panel 12 and the left and right shoulder straps 52 and 80, so that the left and right shoulder strap top 53 and 81 move over the human's shoulders 114 and 116 and connecting the fasteners on the left and right shoulder straps 54 and 82 to the fasteners 38 on the left panel rear surface 36, as shown in FIGS. 9 and 4.

Figure 5:
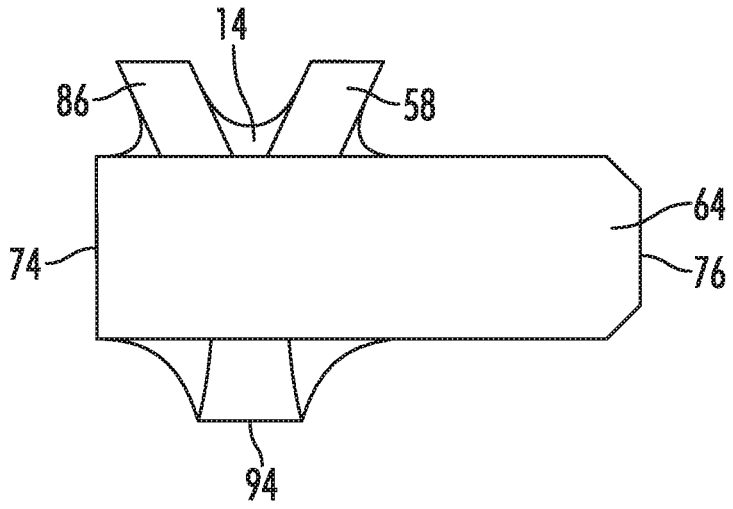
FIG. 5 illustrates a front plan view of the child wrap of FIG. 4 after folding the right panel toward the left and right shoulder straps, the bottom strap, the left panel and the center panel, along a foldline located at the intersection of the center panel and the right panel, so that a portion of the right panel front surface confronts and attaches to the rear side of the left panel and so that the at least one left fastener of the right panel attaches to the left panel rear surface fastener.
Figure 10:
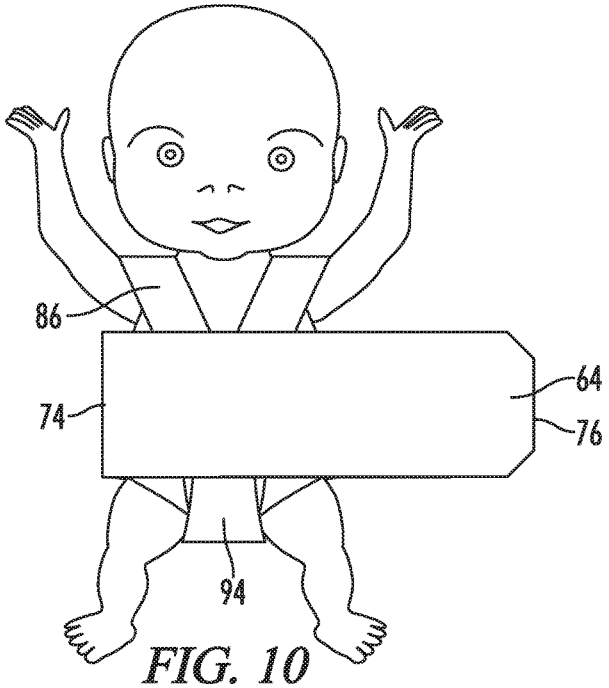
FIG. 10 is a front plan view of the child wrap similar to that shown in FIG. 5 except that a child has been used to illustrate how the child wrap would be used with a child.

The method may then include folding the right panel 60 toward the human's torso 120, the left and right shoulder straps 52 and 80, the bottom strap 88, the left panel 32 and the center panel 12 along a foldline located at the intersection of the center panel 12 and the right panel 60, while maintaining the right panel 60 below the human's right shoulder 116 and below the human's head 102, so that a portion of the right panel front surface 62 confronts and attaches to the rear side of the left panel 36 and is located in front of the front side of the human's torso 122 and so that the at least one left fastener 66B of the right panel 60 attaches to the left panel rear surface fastener 38 and so that the right panel 60 is located to the left of the human's right arm 106 and below the human's right armpit 110 (i.e., the left arm 104 is not captured by the left panel 32), as shown in FIGS. 10 and 5.

Figure 6:
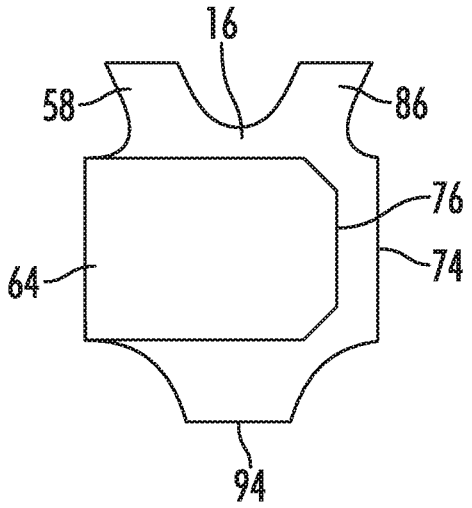
FIG. 6 illustrates a back plan view of the child wrap of FIG. 5 after moving the right side of the right panel so that the right side of the right panel is behind the center panel and connecting the at least one right side fastener of the right panel to the center panel rear surface fastener.
Figure 11:
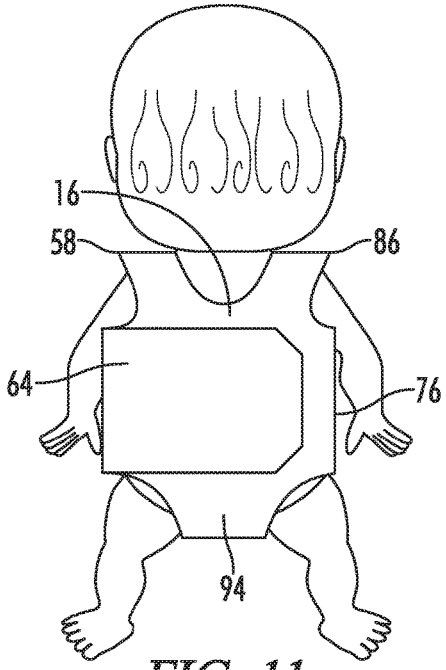
FIG. 11 is a rear plan view of the child wrap similar to that shown in FIG. 6 except that a child has been used to illustrate how the child wrap would be used with a child.
Figure 12:
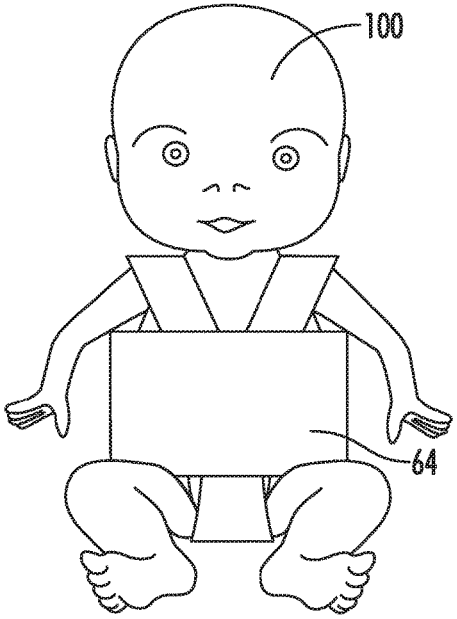
FIG. 12 is a front plan view of the child wrap of FIG. 11.

The method may then include moving the right side of the right panel 76 between the human's torso 120 and the human's right arm 106 below the human's left armpit 112 and then behind the human's torso 120 so that the right side of the right panel 76 is behind the center panel 12 and connecting the at least one right fastener 66A of the right panel 60 to the center panel rear surface fastener 18, as shown in FIGS. 11 and 6.

Optionally, the fasteners are hook and loop fasteners (e.g., VELCRO), e.g., hook and loop fastener strips, as shown in FIGS. 1-12.

Optionally, the left panel 32, the center panel 12, the left and right shoulder straps 52 and 80, the bottom strap 88, and the right panel 60 are a single piece of fabric. In other words, the "panels" 12 32 60 are preferably not discrete parts but preferably, the center panel 12 is a center portion of the single piece of fabric, the right panel 60 is the right portion of the single piece of fabric, the left panel 32 is the left portion of the single piece of fabric and the shoulder straps 52 and 80 and the bottom straps 88 are upper and lower portions, respectively, of the single piece of fabric, as shown in FIGS. 1-12. In addition, the single piece of fabric may be foldable at any point so that the location of the foldlines vary depending on the size of the child. Thus, it will be appreciated that the term "foldlines" does not denote scored or otherwise marked surfaces. The child wrap 10 may be made of any particular fabric or other material. Felt is a preferred fabric.

Optionally, in FIGS. 2 and 7, the rear surfaces of the left panel 36, the center panel 16, the left and right shoulder straps 52 and 80, the bottom strap 88 and the right panel 60 are located on a flat surface during the folding process (e.g., on a table).

Optionally, the bottom strap 88 is located opposite the cavity 134 created by the left and right shoulder straps 52 and 80 and is located approximately in the widthwise center of the center panel 30, as shown in FIGS. 2 and 7.

As shown in FIG. 7, preferably the left panel front surface 34 does not include a fastener because it will be placed against the human's torso as shown in FIG. 8.

Optionally, the left panel 32 and the right panel 60 are generally rectangular in shape, as shown in for example FIGS. 1, 2 and 7.

As shown in FIG. 1, for example, the rear surface hook and loop fasteners of FIG. 1 (i.e., center panel rear fastener 18 and left panel rear fastener 38) may differ from the front surface fasteners shown in FIG. 2 (i.e., right panel at least one right fastener 66A and at least one left fastener 66B, left shoulder strap fastener 54, right shoulder strap fastener 84, and bottom strap fastener 92), as indicated by the difference in hash marks. In particular, the rear surface hook and loop fasteners 18 and 38 of FIG. 1 are preferably female (so that they are soft because the panels comprising these fasteners confronts the child 100), whereas the front surface fasteners 66A, 66B, 54, 84 and 92 of FIG. 2 are preferably male.

Optionally, the bottom strap 88 width tapers from the bottom strap top 97 to the bottom strap bottom 99, as shown in, for example, FIGS. 1, 2, 3, 7 and 8.

Optionally, the at least one left fastener 66B of the right panel 60 is oriented generally perpendicular to the at least one right fastener of the right panel 66, as shown in FIGS. 2, 7 and 8 for example.

The preferred lengthwise and widthwise orientation of the fasteners 18, 38, 54, 66, 82, and 92 is shown in FIGS. 1-12.

Optionally, the bottom strap fastener 92 is located adjacent to the bottom strap bottom end 99, as best seen in FIGS. 2, 3, 7 and 8 for example.

It will be understood that use of the singular embraces use of the plural herein as the center panel 12, left panel 32, right and left shoulder straps 52 and 80 and bottom strap 88 each include two hook and loop fastener strips.

In addition the right panel corners 132 and left panel corners 130 may not be 90 degree square corners but instead may be angled or rounded, as shown in FIGS. 1-11, to minimize unintentional folding and excess bulk.

In addition (not shown), the child wrap may be modified by reversing the left panel and the right panel. More particularly, in the reversed embodiment, the left panel is longer than the right panel, the left panel includes two fastener sets (a right set and a left set) located on the front surface (instead of fasteners on the rear surface), and the right panel includes fasteners on the rear surface (instead of fasteners on the front surface). In such a case, the right panel is folded first (just as the left panel in the previous embodiment) and the left panel is the panel that wraps around the human in the final step. However, the illustrated embodiment of FIGS. 1-12 is the preferred configuration, because most users are right handed, and the user's right hand can be placed over the child 100 during the steps shown in FIG. 8-10 as the right panel 60 is wrapped around the child.

Part List

10 child wrap
12 center panel
14 center panel front surface
16 center panel rear surface
18 center panel rear fastener
20 center panel top
22 center panel bottom
24 center panel height
26 center panel left side
28 center panel right side
30 center panel width
32 left panel
34 left panel front surface
36 left panel rear surface
38 left panel rear fastener
40 left panel top
42 left panel bottom
44 left panel height
46 left panel left side
48 left panel right side
50 left panel width
52 left shoulder strap
54 left shoulder strap fastener
56 left shoulder strap front surface
58 left shoulder strap rear surface
60 right panel
62 right panel front surface
64 right panel rear surface
66A right panel at least one right fastener
66B right panel at least one left fastener
68 right panel top
70 right panel bottom
72 right panel height
74 right panel left side
76 right panel right side
78 right panel width
80 right shoulder strap
82 right shoulder strap fastener
84 right shoulder strap front surface
86 right shoulder strap rear surface
88 bottom strap
90 bottom strap front surface
92 bottom strap fastener
94 bottom strap rear surface
96 bottom strap height
98 bottom strap width
100 Human/child
102 human head
104 human left arm
106 human right arm
108 human left armpit
110 human right armpit
112 human neck
114 human left shoulder
116 human right shoulder
118 human groin region
120 human torso
122 human torso front
124 human torso rear
126 human left leg
128 human right leg
130 Left panel corners
132 Right panel corners
97 bottom strap top
99 bottom strap bottom
53 left shoulder strap top
134 cavity
81 right shoulder strap top

Having now described the invention in accordance with the requirements of the patent statutes, those skilled in the art will understand how to make changes and modifications to the disclosed embodiments to meet their specific requirements or conditions. Changes and modifications may be made without departing from the scope and spirit of the invention. In addition, the steps of any method described herein may be performed in any suitable order and steps may be performed simultaneously if needed.

Terms of degree such as "generally", "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

What is claimed is:

1. A method of providing comfort to a human having a head, a left arm, a right arm, a left armpit, a right armpit, a neck, a left shoulder, a right shoulder, a groin region, a torso having a front side and a rear side, a left leg and a right leg, the method comprising the steps of:

a) providing a wrap comprising:

i. a center panel having a center panel front surface, a center panel rear surface comprising a center panel rear fastener, a center panel top, a center panel bottom, a center panel height extending from the center panel top to the center panel bottom, a center panel left side, a center panel right side, and a center panel width extending from the center panel left side to the center panel right side;

ii. a left panel extending from the center panel left side and comprising a left panel top, a left panel bottom, a left panel height extending from the left panel top to the left panel bottom and generally parallel to the center panel height, a left panel left side, a left panel right side, a left panel width extending from the left panel left side to the left panel right side and generally parallel to the center panel width, a left panel front surface, and a left panel rear surface comprising a fastener;

iii. left and right shoulder straps extending from the center panel top, each of the left and right shoulder straps comprising a front surface comprising a fastener and a rear surface, the left and right shoulder straps separated by a cavity;

iv. a bottom strap extending from the center panel bottom and comprising a front surface comprising a bottom strap fastener, a rear surface, a bottom strap top, a bottom strap bottom, a bottom strap height extending from the bottom strap top to the bottom strap bottom and generally parallel to the center panel height, a bottom strap width generally perpendicular to the bottom strap height and generally parallel to the center panel width; and v. a right panel extending from the center panel right side and comprising a right panel top, a right panel bottom, a right panel height extending from the right panel top to the right panel bottom and generally parallel to the center panel height and the left panel height, a right panel left side, a right panel right side, a right panel width extending from the right panel left side to the right panel right side and generally parallel to the center panel width and the left panel width, a right panel front surface comprising at least one left fastener and at least one right fastener located to the right of the at least one left fastener, wherein the right panel width is larger than the center panel width and the left panel width, and further wherein the right panel height is substantially equal to the left panel height;

b) placing the rear side of the human's torso against the front surface of the center panel and positioning the human so that the bottom strap is located between the human's legs and the bottom strap bottom end is below the human's groin region;

c) folding the left panel toward the human's torso and the center panel along a foldline located at the intersection of the center panel and the left panel, while maintaining the left panel below the human's left shoulder and below the human's head, so that the left panel front surface confronts the front side of the human's torso and so that the left panel is located below the human's left armpit;

d) folding the bottom strap, along a foldline located at the intersection of the center panel and the bottom strap, so that the bottom strap bottom moves toward the left panel rear surface and moves around the human's groin region;

e) connecting the bottom strap fastener to the left panel fastener;

f) folding the left and right shoulder straps, along foldlines located at the intersection of the center panel and the left and right shoulder straps, so that the left and right shoulder strap top move over the human's shoulders;

g) connecting the fasteners on the left and right shoulder straps to the fasteners on the left panel rear surface;

h) folding the right panel toward the human's torso, the left and right shoulder straps, the bottom strap, the left panel and the center panel along a foldline located at the intersection of the center panel and the right panel, while maintaining the right panel below the human's right shoulder and below the human's head, so that a portion of the right panel front surface confronts and attaches to the rear side of the left panel and is located in front of the front side of the human's torso and so that the at least one left fastener of the right panel attaches to the left panel rear surface fastener and so that the right panel is located to the left of the human's right arm and below the human's right armpit;

i) moving the right side of the right panel between the human's torso and the human's left arm below the human's left armpit and then behind the human's torso so that the right side of the right panel is behind the center panel; and j) connecting the at least one right side fastener of the right panel to the center panel rear surface fastener.

2. The method of claim 1 wherein said fasteners are hook and loop fasteners.

3. The method of claim 1 wherein said human's arms remain free during steps a) through j).

4. The method of claim 1 wherein the left panel, the center panel, the left and right shoulder straps, the bottom strap, and the right panel are a single piece of fabric.

5. The method of claim 1, wherein the right side of the right panel and the left side of the left panel comprise angled corners.

6. The method of claim 1, wherein, in step a), the bottom strap is located opposite the cavity created by the left and right shoulder straps and is located approximately in the widthwise center of the center panel.

7. The method of claim 1, wherein the left panel and the right panel are generally rectangular in shape.

8. The method of claim 1, wherein the bottom strap width tapers from the bottom strap top to the bottom strap bottom.

9. The method of claim 1 wherein the at least one left fastener of the right panel is oriented generally perpendicular to the at least one right fastener of the right panel.

10. The method of claim 1, wherein the bottom strap fastener is located adjacent to the bottom strap bottom end.

11. A method of providing comfort to a human having a head, a left arm, a right arm, a left armpit, a right armpit, a neck, a left shoulder, a right shoulder, a groin region, a torso having a front side and a rear side, a left leg and a right leg, the method comprising the steps of:

a) providing a wrap comprising:

i. a center panel having a center panel front surface, a center panel rear surface comprising a center panel rear fastener, a center panel top, a center panel bottom, a center panel height extending from the center panel top to the center panel bottom, a center panel left side, a center panel right side, and a center panel width extending from the center panel left side to the center panel right side;

ii. a left panel extending from the center panel left side and comprising a left panel top, a left panel bottom, a left panel height extending from the left panel top to the left panel bottom and generally parallel to the center panel height, a left panel left side, a left panel right side, a left panel width extending from the left panel left side to the left panel right side and generally parallel to the center panel width, a left panel front surface comprising at least one left fastener and at least one right fastener located to the right of the at least one left fastener, and a left panel rear surface;

iii. left and right shoulder straps extending from the center panel top, each of the left and right shoulder straps comprising a front surface comprising a fastener and a rear surface, the left and right shoulder straps separated by a cavity;

iv. a bottom strap extending from the center panel bottom and comprising a front surface comprising a bottom strap fastener, a rear surface, a bottom strap top, a bottom strap bottom, a bottom strap height extending from the bottom strap top to the bottom strap bottom and generally parallel to the center panel height, a bottom strap width generally perpendicular to the bottom strap height and generally parallel to the center panel width; and v. a right panel extending from the center panel right side and comprising a right panel top, a right panel bottom, a right panel height extending from the right panel top to the right panel bottom and generally parallel to the center panel height and the left panel height, a right panel left side, a right panel right side, a right panel width extending from the right panel left side to the right panel right side and generally parallel to the center panel width and the left panel width, a right panel front surface and a rear panel rear surface, wherein the left panel width is larger than the center panel width and the right panel width, and further wherein the left panel height is substantially equal to the right panel height;

b) placing the rear side of the human's torso against the front surface of the center panel and positioning the human so that the bottom strap is located between the human's legs and the bottom strap bottom end is below the human's groin region;

c) folding the right panel toward the human's torso and the center panel along a foldline located at the intersection of the center panel and the right panel, while maintaining the right panel below the human's right shoulder and below the human's head, so that the right panel front surface confronts the front side of the human's torso and so that the right panel is located below the human's right armpit;

d) folding the bottom strap, along a foldline located at the intersection of the center panel and the bottom strap, so that the bottom strap bottom moves toward the right panel rear surface and moves around the human's groin region;

e) connecting the bottom strap fastener to the right panel fastener;

f) folding the left and right shoulder straps, along foldlines located at the intersection of the center panel and the left and right shoulder straps, so that the left and right shoulder strap top move over the human's shoulders;

g) connecting the fasteners on the left and right shoulder straps to the fasteners on the right panel rear surface;

h) folding the left panel toward the human's torso, the left and right shoulder straps, the bottom strap, the right panel and the center panel along a foldline located at the intersection of the center panel and the left panel, while maintaining the left panel below the human's left shoulder and below the human's head, so that a portion of the left panel front surface confronts and attaches to the rear side of the right panel and is located in front of the front side of the human's torso and so that the at least one right fastener of the left panel attaches to the right panel rear surface fastener and so that the left panel is located to the right of the human's left arm and below the human's left armpit;

i) moving the left side of the left panel between the human's torso and the human's right arm below the human's right armpit and then behind the human's torso so that the left side of the left panel is behind the center panel; and j) connecting the at least one left fastener of the left panel to the center panel rear surface fastener.

12. The method of claim 11 wherein said fasteners are hook and loop fasteners.

13. The method of claim 11 wherein said human's arms remain free during steps a) through j).

14. The method of claim 11 wherein the left panel, the center panel, the left and right shoulder straps, the bottom strap, and the right panel are a single piece of fabric.

15. The method of claim 11, wherein the right side of the right panel and the left side of the left panel comprise angled corners.

16. The method of claim 11, wherein, in step a), the bottom strap is located opposite the cavity created by the left and right shoulder straps and is located approximately in the widthwise center of the center panel.

17. The method of claim 11, wherein the left panel and the right panel are generally rectangular in shape.

18. The method of claim 11, wherein the bottom strap width tapers from the bottom strap top to the bottom strap bottom.

19. The method of claim 11 wherein the at least one left fastener of the left panel is oriented generally perpendicular to the at least one right fastener of the left panel.

20. The method of claim 11, wherein the bottom strap fastener is located adjacent to the bottom strap bottom end.

* * * * *